United States Patent [19]

Burgess et al.

[11] Patent Number: 4,608,463

[45] Date of Patent: Aug. 26, 1986

[54] ELECTRO-ACOUSTIC TRANSDUCER

[75] Inventors: David A. Burgess, Harlow; Malcolm R. King, Hertford, both of United Kingdom

[73] Assignee: International Standard Electric Corporation, New York, N.Y.

[21] Appl. No.: 632,570

[22] Filed: Jul. 19, 1984

[51] Int. Cl.[4] ..... H04R 9/00; H04R 9/04

[52] U.S. Cl. ..... 179/115.5 R; 179/115.5 VC

[58] Field of Search ..... 179/115.5 R, 115.5 PC, 179/115.5 DV, 115.5 VC, 117, 119 R

[56] References Cited

U.S. PATENT DOCUMENTS

| | | | |
|---|---|---|---|
| 2,392,143 | 1/1946 | Graham | 179/115.5 VC |
| 2,556,816 | 6/1951 | Lukacs | 179/115.5 R |
| 2,590,935 | 4/1952 | Charlesworth | 179/115.5 PC |
| 2,714,134 | 7/1955 | Touger et al. | 179/115.5 R |
| 3,230,319 | 1/1966 | Kliewer | 179/115.5 R |
| 3,364,315 | 1/1968 | Görike | 179/115.5 R |
| 3,930,129 | 12/1975 | Cohen et al. | 179/115.5 R |
| 4,547,632 | 10/1985 | Bryson | 179/119 R |

*Primary Examiner*—Gene Z. Rubinson
*Assistant Examiner*—Danita R. Byrd
*Attorney, Agent, or Firm*—John T. O'Halloran; Thomas F. Meagher

[57] ABSTRACT

An electro-acoustic transducer of the moving coil type, which includes a driven unit including a drive coil, and a magnet unit including a magnet and two pole-piece so located as to define an annular air gap in which the coil is located. The driven unit further includes a substantially circular central portion whose outer periphery is secured to the coil, an an outer portion whose inner periphery is secured to the coil and whose outer periphery is secured to a member of said transducer, which contains said magnet unit at a flat face of the member. The transducer member is substantially cylindrical. A flat cup-like member of larger diameter than the member is secured to the flat face. The driven unit also includes a cone whose inner periphery is secured to the coil and whose outer periphery is secured to the outer rim of the cup-like member.

6 Claims, 3 Drawing Figures

ELECTRO-ACOUSTIC TRANSDUCER

BACKGROUND OF THE INVENTION

This invention relates to an electro-acoustic transducer of the moving coil type, which is suitable for use as a tone caller for a telephone subscriber's instrument, or as a loudspeaker, e.g. in a loudspeaking telephone.

SUMMARY OF THE INVENTION

According to the invention there is provided an electro-acoustic transducer of the moving coil type, which includes a driven unit including a drive coil, and a magnet unit including a magnet and pole-piece so located as to define an annular air gap in which the coil is located, wherein the outer periphery of the driven unit is secured to part of the structure of the transducer and wherein the driven unit also has a cone whose inner periphery is secured to the coil-carrying part of the driven unit.

According to the invention there is further provided an electro-acoustic transducer of the moving coil type, which includes a driven unit including a drive coil, and a magnet unit including a magnet and pole pieces located as to define an annular air gap in which the coil is located, wherein the driven unit is made in a plurality of parts one of which is a substantially circular central part whose outer periphery carries the coil, a second of which is substantially annular support member the inner perphery of which is secured to the coil carrying part of the central part and whose outer periphery is secured to part of the structure of the transducer, and a third part of which is a cone whose inner perphery is also secured to the coil carrying part of the central part and whose outer periphery is secured to part of the structure of the transducer.

Such a transducer may be a development of the transducer described and claimed in our Application No. 8203650 (F. Taylor et al 7-7-3-1-1-25), (which corresponds to U.S. patent application Ser. No. 464,827 filed Feb. 8, 1983 and abandoned June 6, 1985, for which a continuation application, Ser. No. 719,936 was filed on Apr. 4, 1985, and is now pending) and the embodiments to be described herein may use many of the piece parts of that transducer. This means that cost of production is substantially reduced as compared with other tone callers or loudspeakers.

BRIEF DESCRIPTION OF THE DRAWINGS

Embodiments of the invention will now be described with reference to the accompanying drawing, in which.

DESCRIPTION OF THE PREFERRED EMBODIMENT

The transducers described herein are so designed that fully automated assembly can be achieved, and the assembly technique used ensures that the driving coil is accurately positioned in the air gap. This coil is wound on an aluminium former, which ensures accuracy of shape, and the aluminium also acts as an electrical damper. The outer part of the driven unit is formed in situ on a mounting ring, such that a nest into which the speech coil locates is accurately positioned with respect to the datum diameter on that mounting ring. The same datum also positions the outer pole piece of the magnetic assembly, which reduces the build up of tolerances associated with conventional transducers. The formation of a nest as just mentioned provides a secure way to attach a speech coil to the driven unit and also protects the coil.

The transducers described herein have a plural part driven unit, which includes the coil former, so that automatic coil winding and termination of the lead out wires can be achieved. It also permits the use of an assembly technique, which ensures accurate alignment of the coil to the pole gap (air gap) and gives a positive means of attaching the coil to the driven unit.

Figure 1:
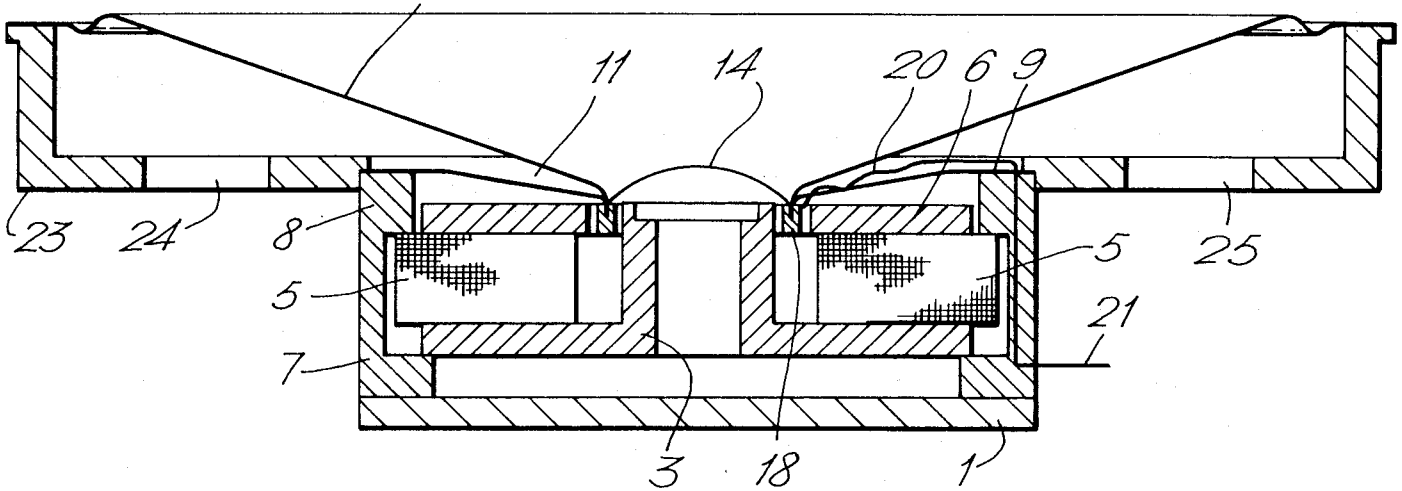
FIG. 1 is a cross-section of a transducer embodying the invention.

The transducer, FIG. 1, has a circular rear cover 1, on which is located the inner pole 3, which is of magnetic material. This pole has a central hole and a flat portion parallel to the rear cover. Secured to this flat portion is an annular magnet 5 so magnetised that its end faces are the poles. This magnet is made from a modern magnetic material having high magnetic strength. The the upper face of the magnet there is secured a disc 6 of magnetic material, whose inner rim provides the outer pole. The poles are so shaped as to provide an annular gap for the reception of the coil.

Also mounted on the rear cover, and ultrasonically welded to it, there is a support ring 7 of a non-magnetic material (like the rear cover) with a mounting ring 8 integral with its upper end. This ring is dimensioned to provide an annular face which locates on the upper face of the magnet. The mounting ring 8 has an end face 9 for supporting an outer ring of the driven unit.

With the method of assembly indicated above it is found that the tolerances accumulate at the welded joint, which facilitates assembly with a low reject rate.

Figure 3:
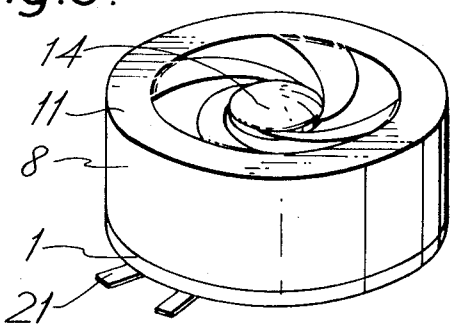
FIGS. 2 and 3 are perspective views of parts of two versions of transducers according to FIG. 1.
Figure 2:
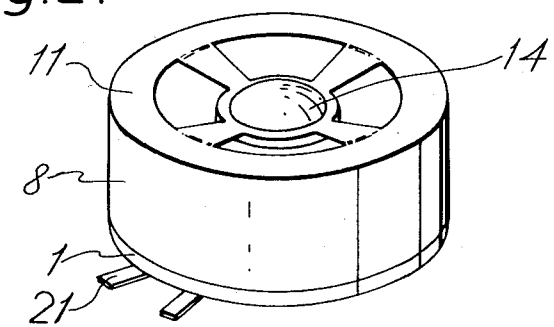

We now consider the driven unit. This includes a two part arrangement, the outer portion of which is an annulus 11 of a suitable stiff insulating material or aluminium whose outer rim is secured to the annular region 9 of the support ring 7. This annulus is slotted with radial members left in situ, as in FIG. 2, or is formed as a spider, as in FIG. 3. The inner part is a bent down cylindrical part with an annular portion at its lower end. The inner part 14 of this unit is of aluminium, and is convex, and it has a cylindrical portion bent down to and integral with an annular portion. The coil 18 is carried by the cylindrical portions of the inner part of the driven unit. Thus this inner part, with the coil, fits accurately into the nest formed by the portions just mentioned of the units outer portion. These parts are not shown in detail; their specific arrangement can be seen by reference to our above-mentioned application.

The leads from the winding, one of which is shown at 20, go from the ends of the winding of the coil 18 to two terminals one of which is shown at 21. Each of these terminals is fixed into a tunnel in the wall of the support ring 7.

The outer side of the transducer carries a cone 22 which is attached at its centre to the coil 18.

This cone is of a stiff material, and has a corrugated outer surround which is fastened to a circular frame 23 whose inner rim seats onto the support ring 8. During the assembly of the transducer, the coil is wound on the cylindrical portion of the inner part of the driven unit, and the result is then assembled to the magnet structure and casing in situ. The outer part of the driven unit is attached to the raised part 9 of the mounting ring 8. Thus the coil is accurately located relative to that datum and so to the magnetic circuit. The magnetic circuit structure is also located by the outer diameter of the outer pole piece 6 relative to the datum surface, thus ensuring the accurate location of the coil in the gap. Thus we do not need adhesive bonding of the coil to the diaphragm, as in many known transducers.

The transducers just described are, in effect, modifications of the transducer of the above-mentioned application, to make them suitable for use as tone callers for so-called electronic telephones, or for loudspeakers as used in loudspeaking telephones. The adaptations consist in replacing the outer part of the diaphragm by a support spider or the like, attaching a cone to the speech coil, central dome, and leaving out the dampers included in the transducer of the above application.

The structure shown in FIG. 1 is, when in use, mounted in the case of the instrument behind a perforated or slotted region, sealed by, for instance a thin membrane to keep dust and moisture out.

We claim:

1. An electro-acoustic transducer of the moving coil type, which includes a driven unit including a drive coil, and a magnet unit including a magnet and two pole-pieces so located as to define an annular air gap in which the coil is located, wherein the driven unit further includes a substantially circular central portion whose outer periphery is secured to the coil, and an outer portion whose inner periphery is secured to the coil and whose outer periphery is secured to a member of said transducer, which contains said magnet unit at a flat face of said member, wherein said member is substantially cylindrical, wherein a flat cup-like member of large diameter than said member is secured to said flat face, and wherein the driven unit also includes a cone whose inner periphery is secured to the coil and whose outer periphery is secured to the outer rim of the cup-like member.

2. A transducer according to claim 1, wherein said outer portion is perforated in a predetermined manner.

3. A transducer according to claim 1, wherein said magnet is an annular magnet, one of said pole pieces is a cylindrical ferromagnetic member having a flat disc like portion adjacent one of its end to support one surface of said annular magnet, and the other of said pole pieces is a flat, annular, ferromagnetic member bearing against the other surface of said annular magnet, said flat, annular member having an inner circular periphery cooperating with an outer periphery of the other end of said cylindrical member of said one of said pole pieces to define said air gap.

4. A transducer according to claim 3, wherein said outer portion is perforated in a predetermined manner.

5. A transducer according to claim 3, wherein each of said circular central part and said outer portion of said driven unit have a portion extending into said air gap to support said drive coil.

6. A transducer according to claim 5, wherein said outer portion is perforated in a predetermined manner.

* * * * *